US008363076B2

(12) United States Patent
Aihara et al.

(10) Patent No.: US 8,363,076 B2
(45) Date of Patent: Jan. 29, 2013

(54) PRINTING APPARATUS AND PRINTING METHOD

(75) Inventors: Yuichi Aihara, Yamanashi-ken (JP); Tsuyoshi Kubota, Yamanashi-ken (JP)

(73) Assignee: Nisca Corporation, Minamikoma-gun, Yamakashi-ken (JP)

( * ) Notice: Subject to any disclaimer, the term of this patent is extended or adjusted under 35 U.S.C. 154(b) by 353 days.

(21) Appl. No.: 12/923,011

(22) Filed: Aug. 30, 2010

(65) Prior Publication Data

US 2011/0050832 A1 Mar. 3, 2011

(30) Foreign Application Priority Data

Aug. 31, 2009 (JP) ..... 2009-200004

(51) Int. Cl.
*B41J 17/08* (2006.01)

(52) U.S. Cl. ..... 347/215; 347/217; 347/216

(58) Field of Classification Search ..... 347/215, 347/216, 217, 218
See application file for complete search history.

(56) References Cited

U.S. PATENT DOCUMENTS 7,956,881 B2 * 6/2011 Aihara ..... 347/217
2009/0116891 A1 * 5/2009 Aihara ..... 400/244

FOREIGN PATENT DOCUMENTS

JP 2009-113228 5/2009

* cited by examiner

*Primary Examiner* — Huan Tran
(74) *Attorney, Agent, or Firm* — Manabu Kanesaka

(57) ABSTRACT

A printing apparatus 1 compares a distance γ from a printing finish position of received printing data to a card rear end with a distance β set corresponding to a peeling distance α in which an ink ribbon R peels off from a card C, and thereby determines whether or not the printing finish position is within the distance β from the card rear end. As a result, when it is determined that the printing finish position is within the distance β from the card rear end, it is controlled that reeling of the ink ribbon R is performed by at least a distance obtained by adding the distance γ to the distance α after printing on the card C is finished, and that the thermal head is then retreated to a retreat position. By this means, when the printing finish position is in the vicinity of the card rear end, the sag of the ink ribbon pulled out by a drop of the thermal head is resolved, and the ink ribbon does not wind itself around the platen roller.

5 Claims, 16 Drawing Sheets

PRINTING APPARATUS AND PRINTING METHOD

BACKGROUND OF THE INVENTION

1. Technical Field

The present invention relates to a printing apparatus, and more particularly, to an apparatus for printing an image on a card supported on its one side by a platen roller by bringing a thermal head into press-contact with the card via an ink ribbon.

2. Description of the Related Art

Conventionally, apparatuses have been known which print an image on a printing sheet supported on its one side by a platen roller by bringing a thermal head into press-contact with the sheet via an ink ribbon. In the aforementioned apparatuses, when press-contact of the thermal head is released after finishing printing, the ink ribbon sags, and is in contact with the platen roller. When a printing sheet is fed in this state, such a case arises that the sagging ink ribbon winds itself around the platen roller by the effect of static electricity.

Then, to solve this problem, for example, Japanese Patent Application Publication No. 2009-113228 discloses a configuration, in a printing apparatus using an ink ribbon with a plurality of colors arranged panel-sequentially, where the ink ribbon is reeled to resolve the sag of the ink ribbon, and further, subsequent positioning of the next color of the ink ribbon is performed.

Further, in the aforementioned printing apparatus, generally, a peeling plate 60 is provided near the thermal head to peel off the ink ribbon from a printing sheet (card) (see FIG. 10). In addition, it is defined that a point in which an ink ribbon R peels off from a card C is a peeling point, and that a distance from a thermal head 51 to the peeling point is $\alpha$. In such a printing apparatus, after printing on the card C is finished, the thermal head 51 is not raised immediately, the ink ribbon R is reeled while transporting the card for the distance $\alpha$, and then, the printing operation is finished (see FIG. 11). According to this configuration, when all-surface printing on the card C is performed, after the card is passed through between the thermal head and platen roller, the thermal head 51 drops onto the platen roller 44. Then, the ink ribbon R is pulled out of a supply spool 54 by force of a drop of the thermal head 51, and as a result, the ink ribbon R sags (see FIG. 12).

However, as described above, since transport of the card and reeling of the ink ribbon is performed from the printing finish position (card rear end) to the position of the peeling point, the sag of the ink ribbon is resolved during this period. Thereafter, the thermal head is raised and the ink ribbon is reeled.

However, when the printing finish position is within $\alpha$ from the card rear end, during the time the ink ribbon R is reeled while transporting the card C for the distance $\alpha$ after printing is finished, the card rear end is passed through between the thermal head 51 and the platen roller 44, and the thermal head 51 drops. Accordingly, when the printing operation is finished immediately after the thermal head 51 drops (the state in FIG. 14), the thermal head 51 is raised while the sag of the ink ribbon R remains. When the platen roller 44 is rotated thereafter, the ink ribbon R winds itself around the platen roller 44, and an error occurs (see FIG. 16).

In view of the aforementioned matter, it is an object of the invention to provide a printing apparatus and printing method for resolving sag of an ink ribbon pulled out by a drop of a thermal head when a printing finish position is in the vicinity of the card rear end, and eliminating winding of the ink ribbon around the platen roller.

BRIEF SUMMARY OF THE INVENTION

To solve the above-mentioned problem, in the invention, a distance $\gamma$ from a printing finish position of received printing data to a card rear end is compared with a distance $\beta$ set corresponding to a peeling distance $\alpha$ in which an ink ribbon R peels off from the card C, and it is thereby determined whether or not the printing finish position is within the distance $\beta$ from the card rear end. Then, when it is determined that the printing finish position is within the distance $\beta$ from the card rear end as a result of comparison, a control means for controlling reeling of the ink ribbon reels the ink ribbon by at least a distance obtained by adding the distance $\gamma$ to the distance $\alpha$ after printing on the card is finished, and then, shifts the thermal head to a retreat position. The invention is characterized by this means.

Advantageous Effect of the Invention

According to the invention, even when the ink ribbon R once sags by the thermal head dropping for a period during which the card C is transported for the distance $\alpha$ in order for the ink ribbon to peel off after printing on the printing medium is finished, the printing operation is not finished with the ink ribbon R sagging, and therefore, the ink ribbon does not wind itself around the platen roller.

BRIEF DESCRIPTION OF THE SEVERAL VIEWS OF THE DRAWINGS

FIG. 2 is a schematic cross-sectional view showing a state of the printer apparatus of the Embodiment in which a blank card prior to recording processing is carried in;

DETAILED DESCRIPTION OF THE INVENTION

Referring to drawings, an Embodiment will be described below in which the present invention is applied to a printer apparatus having the function of printing and recording text and image on a card-shaped printing medium (hereinafter, simply referred to as a card C).

(Configuration)

<System Configuration>

Figure 5:
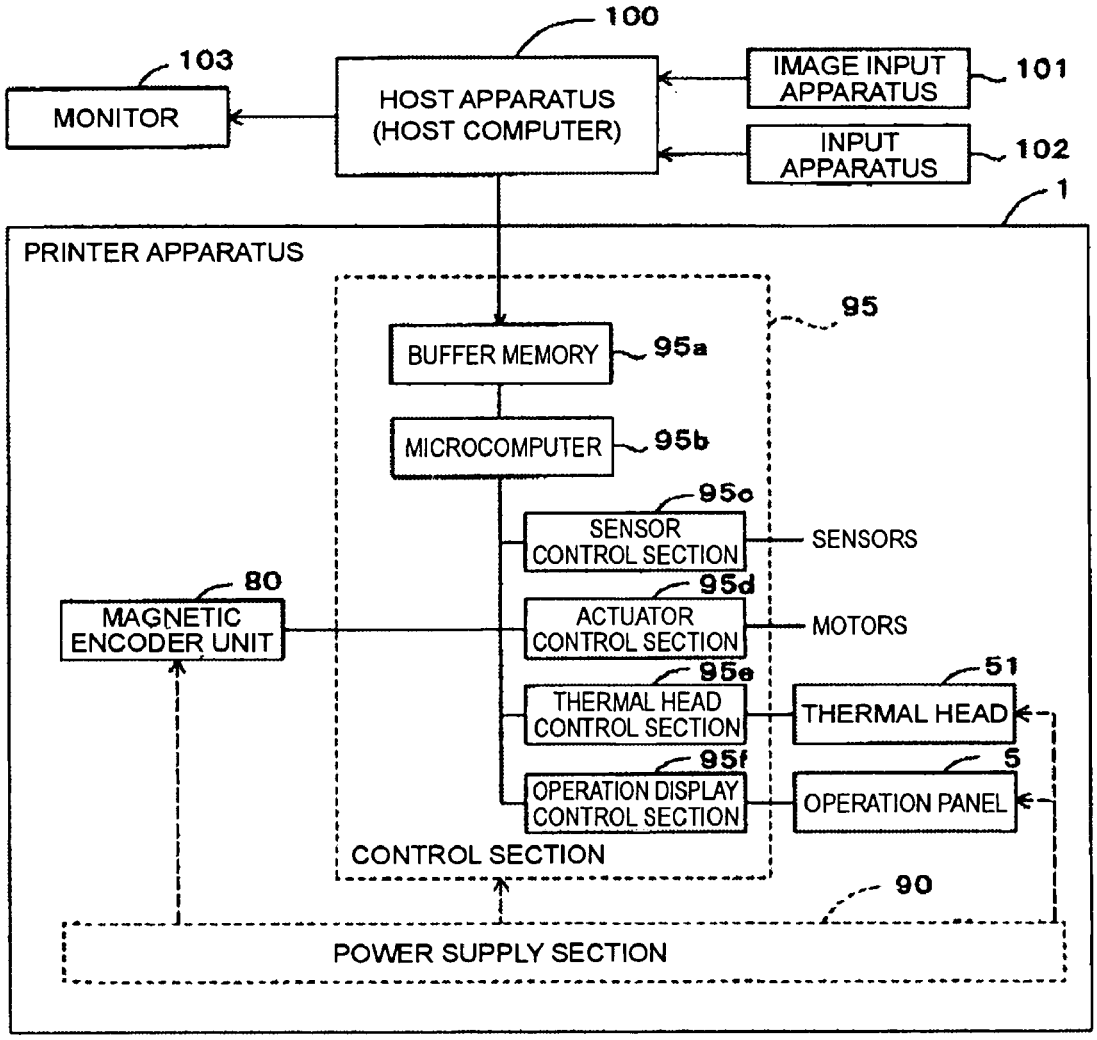
FIG. 5 is a block diagram illustrating a schematic configuration of a control section of the printer apparatus of the Embodiment.

As shown in FIG. 5, a printer apparatus 1 of this Embodiment is connected to a host apparatus 100 (for example, a host computer such as a personal computer) via an interface, omitted in the figure, and the host apparatus 100 transmits printing data, etc. to the printer apparatus 1, and is capable of instructing the apparatus 1 to perform printing operation, etc. In addition, as described later, the printer apparatus 1 has an operation panel section (operation display section) 5 (see FIGS. 1 and 5), and as well as printing operation instructions from the host apparatus 100, it is possible to provide recording operation instructions from the operation panel section 5.

Generally, the host apparatus 100 is connected to an image input apparatus 101 such as a scanner that reads an image recorded on an original document, an input apparatus 102 such as a keyboard and mouse to input a command and data to the host apparatus 100, and a monitor 103 such as a liquid crystal display that displays data generated by the host apparatus 100, and the like.

<Appearance Configuration>

Figure 1:
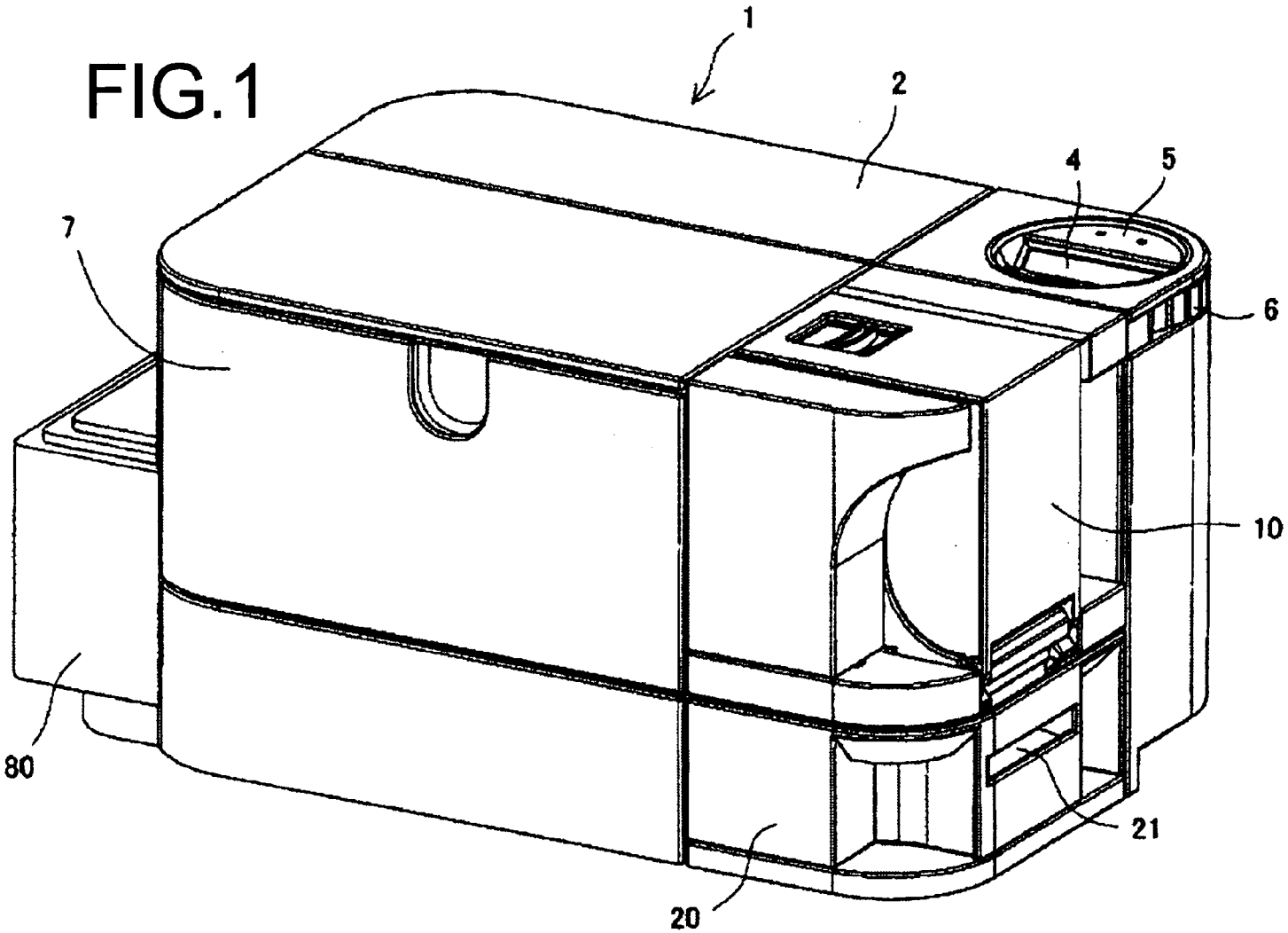
FIG. 1 is a perspective view of an appearance of a printer apparatus of an Embodiment to which the invention is applicable.

As shown in FIG. 1, the printer apparatus 1 of this Embodiment has a card supply section 10 which is disposed on one side of a casing 2 as an apparatus housing, accommodates a plurality of blank cards (about 100 cards) prior to recording processing in a stacked manner, and is detachably attached to the casing 2, a card holding section 20 which is disposed below the card supply section 10 similarly on one side of the casing 2, is capable of holding cards (about 30 cards) subsequent to recording processing in a slanting manner, and is detachably attached to the casing 2, and a display section 4 in a position adjacent to the card supply section 10 similarly on one side of the casing 2 to display the operating status including error status of the printer apparatus 1, and is provided with the operation panel section 5 to perform various settings of printing processing and magnetic recording processing. In addition, the operation panel section 5 is attached rotatably in synchronization with a dial 6 by rotating the dial 6.

In part of the card holding section 20 is provided a card release opening 21 formed as an opening capable of releasing a recording-processed card exceeding the holding limit outside the apparatus. Further, on one surface of the printer apparatus 1 is provided an open/close cover 7 to access the inside of the apparatus in attaching or detaching a cartridge 52 incorporating an ink ribbon R used in printing recording described later, and the open/close cover 7 constitutes part of the casing 2.

Then, a magnetic encoder unit 80 as a second recording section is disposed, opposite the card supply section 10 or card holding section 20, on the other side of the casing 2, with part of the unit 80 protruding from the casing 2.

<Internal Configuration>

Figure 2:
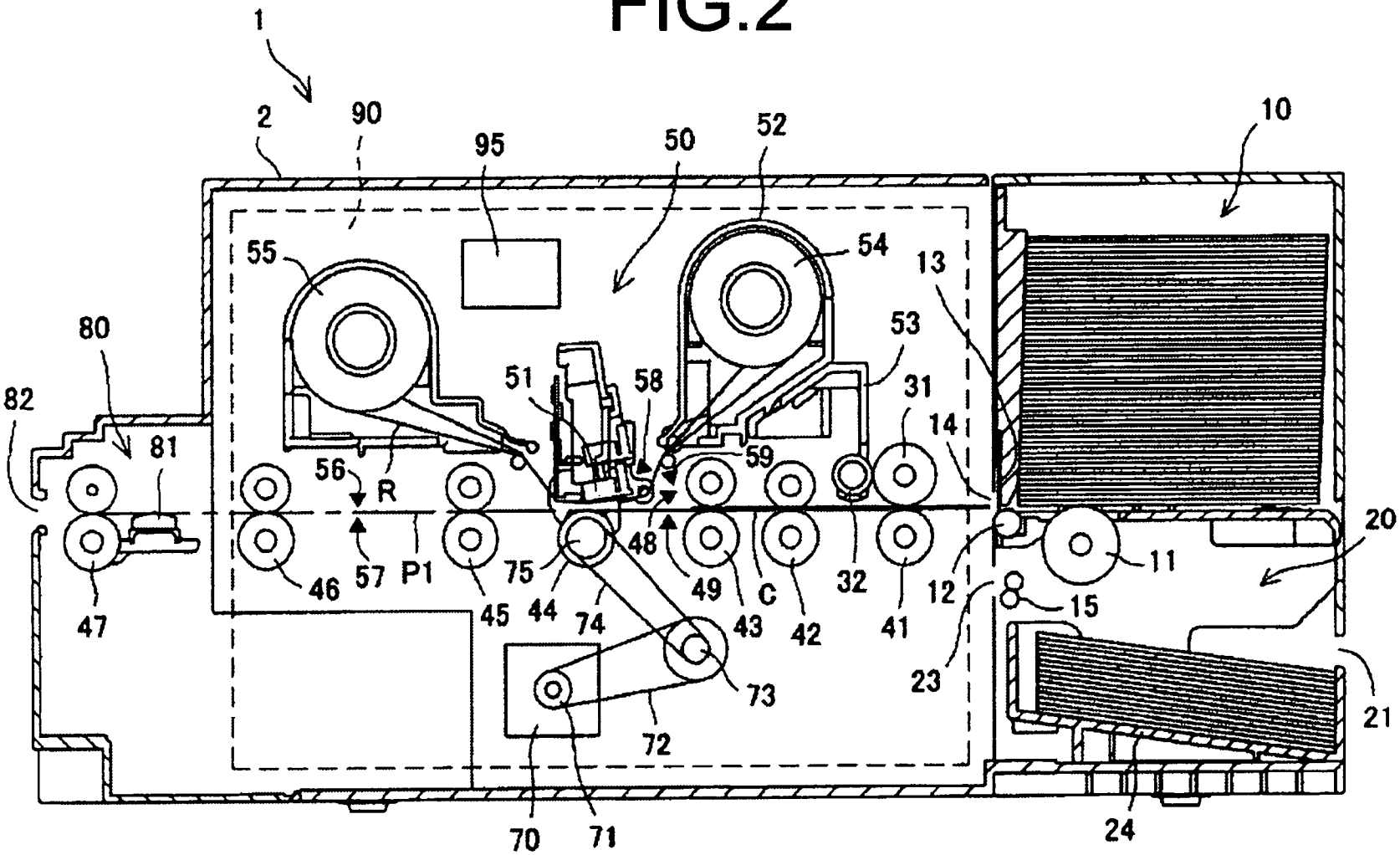

Each component inside the printer apparatus 1 will be described below based on FIGS. 2 and 3. In addition, FIG. 2 shows a state in which a blank card C prior to recording processing supplied from the card supply section 10 is transported toward a printing section 50 as a first recording section, and a cleaning roller 31 as a cleaning member of a card cleaning mechanism 30 comes into contact with a surface of the card C under transport and cleans the surface to be printed.

Figure 3:
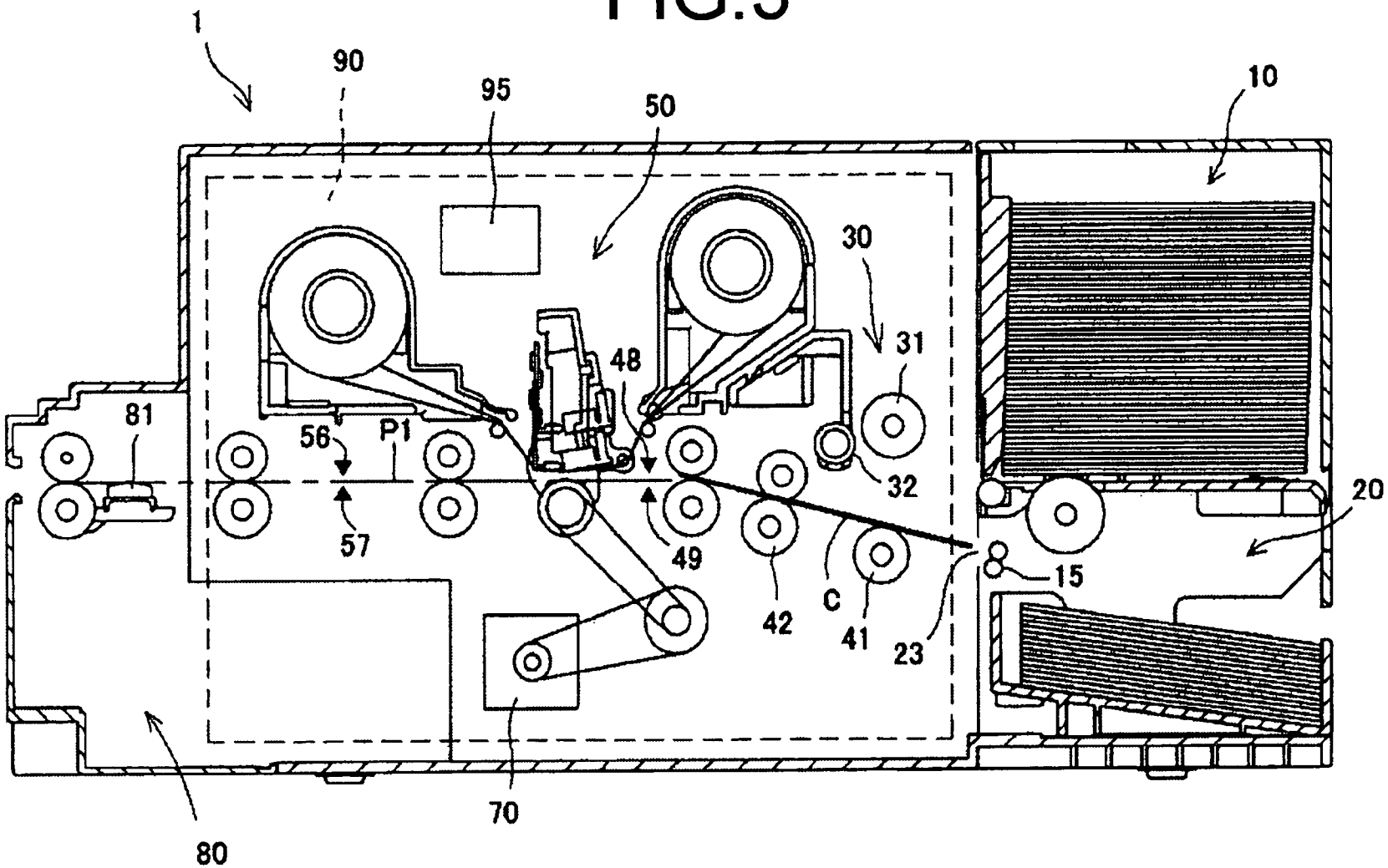
FIG. 3 is another schematic cross-sectional view showing a state of the printer apparatus of the Embodiment in which the recording-processed card is discharged.

Further, FIG. 3 shows a state in which the card C subjected to recording processing by the printing section 50 or magnetic encoder unit 80 is discharged toward the card holding section 20. At this point, transport rollers 41, 42 shift from first positions forming a substantially horizontal card transport path to second positions forming a slanted card transport path, and maintain a state enabling the card C to be transported toward a card discharge outlet 23.

The card supply section 10 is provided detachably to one side of the printer apparatus 1, accommodates a plurality of blank cards prior to recording processing in a stacked manner inside the section 10, and has a separation gate 13 comprised of a supply roller 12 and plate-shaped member to permit passage of only a single card C when a supply roller 11, which is disposed on the apparatus (printer apparatus 1) side and is driven to rotate by a motor omitted in the figure, feeds a lowermost (lowermost layer) card to the inside of the apparatus.

The supplied card C is passed through between the supply roller 12 and separation gate 13, and is guided to a card supply opening 14 provided on one side of the casing 2 to be coupled to the card supply section 10. In addition, more specifically, a flexible pad, not shown, is provided in a lower end portion of the separation gate 13, and for example, even when thin cards with different thicknesses are supplied, enables separation on a sheet-by-sheet basis.

Meanwhile, the card holding section 20 is provided detachably below the card supply section 10 on one side of the printer apparatus 1 (casing 2), and is capable of holding recording-processed cards C in a slanting manner. The card holding section 20 is provided with a holding tray 24 with the bottom inside thereof formed in a slanting shape, and recorded cards C discharged from the card discharge outlet 23, which is disposed below the card supply opening 14 on one side of the casing 2 and has an opening, are sequentially discharged onto the holding tray 24 by a discharge roller 15 and held thereon (see FIG. 3).

The discharge roller 15 is fixed onto the printer apparatus 1 side, is driven to rotate by the motor, omitted in the figure, for driving the supply roller 11 to rotate, and when the direction in which the supply roller 11 rotates to supply a blank card C is assumed to be forward rotation driving, is driven to rotate to discharge the discharged card C onto the holding tray 24 by backward rotation driving of the motor omitted in the figure. In other words, the supply roller 11 and discharge roller 15 are rotated by forward and backward rotation driving of the motor omitted in the figure, and the supply roller 11 is provided with a one-way clutch not shown, and therefore, is capable of rotating only in the card supply direction (by the action of the one-way clutch, rotation driving is not conveyed in the direction opposite to the card supply direction.) Meanwhile, the discharge roller 15 is driven to rotate in both directions by forward and backward rotation driving of the motor omitted in the figure. In this Embodiment, the supply operation of a blank card C is not performed concurrently with the discharge operation of a recording-processed card C, and the discharge roller 15 has no interference in rotating to discharge the card C and rotating in the opposite direction.

The card C supplied from the card supply opening 14 is fed successively to the transport rollers 41, 42, 43 rotating with the driving force conveyed from a transport driving motor 70, described later, and is transported along a substantially horizontal card transport path P1. In addition, each of the transport rollers 42, 43 is comprised of a roller pair having a driving roller and driven roller (hereinafter, unless there is a specific different description, the description on the driven roller of a roller pair is omitted, and only the driving roller is described.)

On the side opposed to the transport roller 41, the cleaning roller 31 constituting part of the card cleaning mechanism 30, described later, is provided to be able to move and retreat into/from the card transport path P1 to be opposed to the transport roller 41. When the cleaning roller 31 moves onto the card transport path P1 to come into contact with the transported card C (the state shown in FIG. 2), the roller 31 rotates while sandwiching the card C with the transport roller 41 having the driving force, and is thereby capable of removing foreign substances such as dust and dirt from a printing surface undergoing printing recording by the printing section 50 to clean.

Further, when the cleaning roller 31 moves onto the card transport path P1 that is the operating position, the cleaning roller 31 is positioned to come into surface-contact with a roller-shaped cleaner 32 disposed in a predetermined position which is a position adjacent to the cleaning roller 31 and is spaced from the card transport path P1. The roller-shaped cleaner 32 has the outside diameter (roller diameter) smaller than the outside diameter (roller diameter) of the cleaning roller, and is provided rotatably while being fixed to a support member 53 detachably attached to a predetermined portion of the cartridge 52 incorporating the ink ribbon R as an ink medium constituted as part of the printing section 50.

In this Embodiment, the cleaning roller 31 is formed of a rotatable roller-shaped member such as a rubber material having adherence on its surface. Meanwhile, the roller-shaped cleaner 32 is formed by winding an adhesive tape having a sponge layer around a rotatable roller-shaped member made of a resin, the adhesive tape has higher adherence than the adherence of the surface of the cleaning roller 31, and therefore, foreign substances such as dust and dirt adhering to the surface of the cleaning roller 31 that are removed from the card C transfer and are delivered to the adhesive tape forming the surface of the roller-shaped cleaner 32 by surface-contact between the roller 31 and cleaner 32.

On the downstream side in the card transport direction of the transport roller 43 is provided the printing section 50 that prints and records predetermined text and/or image on the surface of the card C that is cleaned by the cleaning roller 31.

In this Embodiment, the printing section 50 adopts the configuration of a thermal transfer printer, and has a thermal head 51 provided to move and retreat to/from a platen roller 44 provided in a printing position on the card transport path P1. In between the platen roller 44 and thermal head 51 exists the ink ribbon R with panels of a plurality of colors such as ink layers Y (Yellow), M (Magenta), C (Cyan) and Bk (Black) and Op (protective layer) repeated panel-sequentially. The ink ribbon R is incorporated into the cartridge 52 as described previously. The ink ribbon R is wound (held) around each of a supply reel 54 and take-up reel 55 inside the cartridge 52, the unused ink ribbon R is wound around the supply reel 54, and the already used ink ribbon R (subsequent to thermal transfer by the thermal head 51) is wound around the take-up reel 55.

In thermal-transfer recording information such as text and image on the card C moving along the card transport path P1, the ink ribbon R is supplied from the ribbon supply reel 54, transported while bringing the substantially entire surface into contact with the front end portion of the thermal head 51, and wound around the ribbon take-up reel 55 to reel the ink ribbon R. The ribbon supply reel 54 and ribbon take-up reel 55 are driven to rotate by a take-up reel driving motor 150. At this point, the predetermined text and/or image is printed on the card C by selectively operating heating elements of the thermal head 51 while pressing the thermal head 51 with the ink ribbon R existing on the surface of the card C. In the transport path of the ink ribbon R are disposed a plurality of guide shafts and a transmission sensor comprised of a light-emitting device 58 and light-receiving device 59 that detect the ink layer Bk (Black) to position a predetermined ink layer (ink layer Y in this Embodiment).

An engagement portion on the apparatus body side corresponding to an engagement portion 55A of the take-up reel 55 is comprised of a plurality of members. In other words, a support shaft 154 is fixed to the apparatus frame, and the support shaft 154 axially supports a disk-shaped engagement portion 152 having a gear on the periphery to be rotatable. The engagement portion 152 is provided with an engagement convex portion 152A engaging in the engagement portion 55A of the take-up reel 55.

Figure 4:
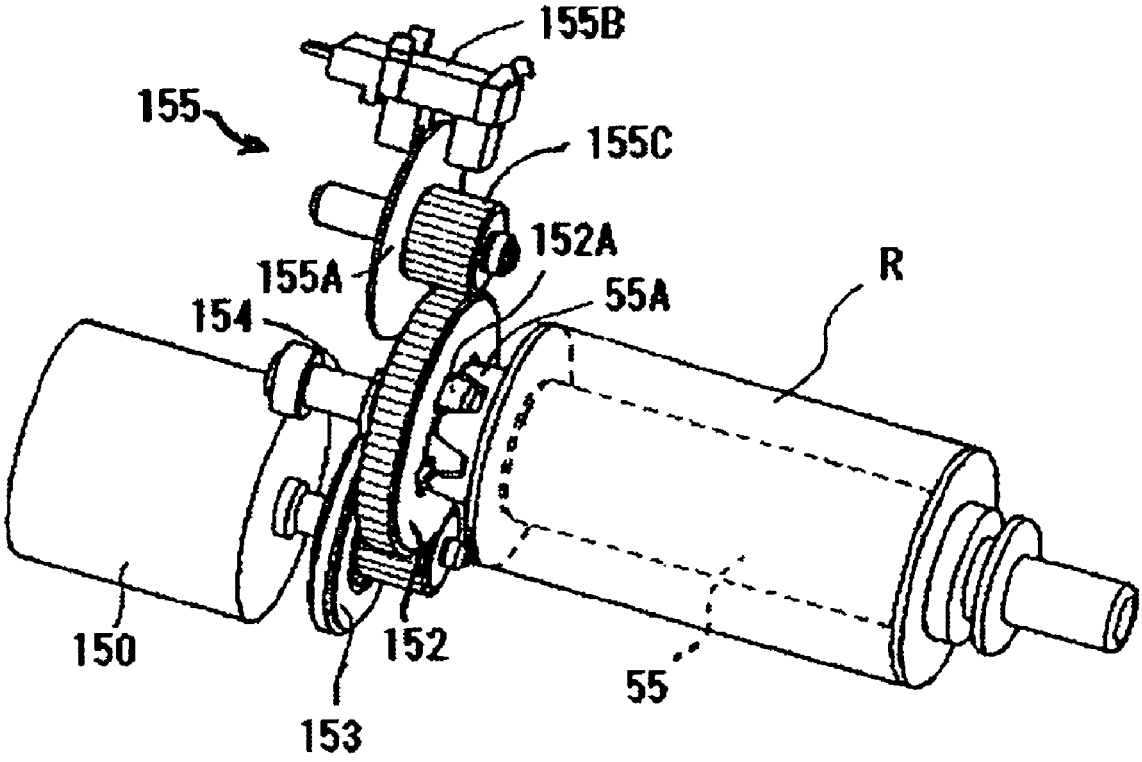
FIG. 4 is a perspective view of an appearance of an engagement portion of the printer apparatus engaging in a reel body on the take-up reel side.

FIG. 4 shows an engagement state of the engagement portion 55A of the take-up reel 55 and the engagement member 152 (engagement convex portion 152A) on the apparatus body side. The gear of the engagement member 152 meshes with a gear 155C, and to the gear 155C is coaxially fixed a rotation plate 155A with a slit (not shown) formed. Further, in a position for sandwiching the rotation plate 155A is disposed a transmission one-piece sensor 155B comprised of a light-emitting device and light-receiving device. Accordingly, the rotation plate 155A and sensor 155B constitute an encoder 155 for detecting a rotation amount of the take-up reel 55 to reel the ink ribbon R. Further, a gear of the engagement member 152 meshes with a gear 153, and a motor shaft of the take-up reel driving motor 150 (stepping motor) is fitted coaxially with the shaft of the gear 153.

Accordingly, driving of the take-up reel driving motor 150 is conveyed to the take-up reel 55, and the rotation amount of the take-up reel 55 can be detected by the encoder 155.

Meanwhile, in principal, the engagement relationship between the supply reel 54 and the apparatus body side is the same as the above-mentioned engagement relationship between the take-up reel 55 and the apparatus body side, but differs in the respect that a gear 153 meshing with the gear of the engagement portion 152 and a torque limiter (not shown) provided in a coaxial position of the gear 153 to provide the ink ribbon R with back tension are provided, instead of the gear 153 and take-up reel driving motor 150.

On the upstream side (transport roller 43 side) in the card transport direction of the thermal head 51 is disposed a transmission sensor (hereinafter, referred to as a first card detection sensor) comprised of a light-emitting device 48 and light-receiving device 49 to detect a front end and rear end in the transport direction of the card C transported along the card transport path P1.

Below the printing section 50 is disposed the transport driving motor 70 comprised of a stepping motor capable of driving forward and backward rotations for driving a above-mentioned series of transport rollers 41, 42, 43 and platen roller 44 in forward and backward rotations. In addition, the rotation amount of the platen roller 44 can be detected by a rotation amount (the number of steps of the pulse) of the transport driving motor 70. Further, the rotation driving force by the transport driving motor 70 is conveyed from a pulley 71 provided on the rotary shaft of the transport driving motor 70 to a pulley 73 with a belt 72, and is conveyed to the platen roller 44 via a pulley 75 provided on the rotary shaft of the platen roller 44 with a belt 74 at its one end wound around the pulley 73. In addition, the pulley 73 is comprised of a two-stage pulley, and the belts 72 and 74 are looped over respective step height portions.

A plurality of gears, omitted in the figure, is disposed on the rotary shaft of the platen roller 44, on the rotary shafts of the transport rollers 41, 42, 43 and in between the rollers in mesh states, and the rotation driving force conveyed to the platen roller 44 is conveyed to each of the transport rollers 41, 42, 43 via the plurality of gears.

Meanwhile, on the downstream side (on the ribbon take-up reel 55 side) in the card transport direction of the platen roller 44, a nip roller 45 having the function of transporting the card C is provided along the card transport path P1 to nip the card C when the printing section 50 performs printing recording on the card C. On the further downstream side in the card transport direction of the nip roller 45, a feed roller 46 for transporting the card C is provided similarly along the card transport path P1. Substantially in the center between the nip roller 45 and feed roller 46, a transmission sensor (hereinafter, referred to as a second card detection sensor) comprised of a light-emitting device 56 and light-receiving device 57 is disposed to detect the front end in the transport direction of the card C transported along the card transport path P1.

A gear, omitted in the figure, is also provided on the rotary shaft of each of the nip roller 45 and feed roller 46, and further, a plurality of gears, omitted in the figure, is provided in between the platen roller 44 and nip roller 45, and in between the nip roller 45 and feed roller 46. By the plurality of gears, not shown, meshing with one another, the rotation driving force from the transport driving motor 70 is conveyed to the nip roller 45 and feed roller 46 via a driving force transfer mechanism including the above-mentioned pulleys, belts and the plurality of gears, not shown, while branching off from the gear provided on the rotary shaft of the platen roller 44.

Meanwhile, on the ribbon take-up reel 55 side of the thermal head 51, a peeling plate 60 is provided to peel off the ink ribbon R from the card C. By this means, the ink ribbon R peels off from the card C in a position a distance $\alpha$ from the thermal head 51. Accordingly, at the time the card C is transported for the distance $\alpha$ (9.2 mm in this Embodiment) and the ink ribbon R is reeled after finish of printing, the ink ribbon R peels off from the card C (see FIGS. 10 and 11).

Next, control and electrical system of the printer apparatus 1 will be described below. As shown in FIGS. 2 and 3, the printer apparatus 1 has a control section 95 for performing the entire operation control of the printer apparatus 1, and a power supply section 90 for converting utility power into direct current enabling each electromechanical component, control section, etc. to be driven and activated.

<Control Section>

As shown in FIG. 5, the control section 95 is provided with a microcomputer 95*b* for performing the entire control processing of the printer apparatus 1. The microcomputer 95*b* is comprised of a CPU operating at a high-speed clock as a central processing unit, ROM storing basic control operation (program and program data) of the printer apparatus 1, RAM acting as a work area of the CPU, and an internal bus connecting these components.

The microcomputer 95*b* is connected to an external bus. To the external bus are connected an interface, omitted in the figure, to perform communications with the host apparatus 100, and buffer memory 95*a* to temporarily store printing data to print on the card C, magnetic recording data to magnetically record on a magnetic stripe portion of the card C, etc.

Further, to the external bus are connected a sensor control section 95*c* for controlling signals from various sensors, an actuator control section 95*d* for controlling a motor driver for sending a driving pulse and driving power to each motor, etc. a thermal head control section 95*e* for controlling thermal energy of the thermal head 51, an operation display control section 95*f* for controlling the operation panel section 5, and the magnetic encoder unit 80. The sensor control section 95*c* is connected to the first card detection sensor comprised of the light-emitting device 48 and light-receiving device 49, the second card detection sensor comprised of the light-emitting device 56 and light-receiving device 57, and other sensors omitted in the figure, the actuator control section 95*d* is connected to the stepping motor 61, transport driving motor 70, other motors not shown, actuator 34, etc., the thermal head control section 95*e* is connected to the thermal head 51, and the operation display control section 95*f* is connected to the operation panel section 5.

In addition, the power supply section 90 supplies the operation/driving power to the control section 95, thermal head 51, operation panel section 5 and magnetic encoder unit 80 (see FIG. 5).

(Operation)

The operation of the printer apparatus 1 of this Embodiment will be described below with the CPU (hereinafter, simply referred to as the CPU) of the microcomputer 95*b* focused.

When power is supplied to the control section 95, the CPU reads the program and program data stored in the ROM (to expand in the RAM), and performs the initial processing to actuate each electromechanical component. In other words, in the initial processing, the CPU confirms connection to each of control sections 95*a* and 95*c* to 95*f* such as the sensor control section 95*c* constituting the control section 95 and the magnetic encoder unit 80 connected to the microcomputer 95*b* via the external bus, then determines that each structural component is positioned in the above-mentioned home position (see FIG. 2) based on signals from the sensor control section 95*c* and the like, and when any structural component is not positioned in the home position, shifts the component to the home position. When the component does not shift to the home position even by repeating the operation for returning the component to the home position based on the signal from the sensor control section 95*c*, etc., the CPU reports the fact to the host apparatus 100, while displaying the fact in the display section 4 via the operation display control section 95*f*. Further, in the initial processing, the CPU also determines that cards are held in the card supply section 10 and the like based on the signal from the sensor control section 95*c*, etc. When the CPU determines that cards are not held, similarly, the CPU reports the fact to the host apparatus 100, while displaying the fact in the display section 4, and further, waits for cards to be held in the card supply section 10.

Meanwhile, the printer driver installed in the host apparatus 100 determines various parameter values to control the recording operation in the printer apparatus 1 based on a recording command designated by an operator (user), and generates printing data and magnetic recording data to perform recording on the card from the recording command to transmit to the printer apparatus 1. The buffer memory 95*a* of the control section 95 stores image data and/or text data obtained by decomposing various parameter values and printing data that are recording control commands into color components of Y, M, C and Bk, and magnetic recording data. In addition, in this Embodiment, the host apparatus 100 side decomposes into color components (original data is R, G, B), and the printer apparatus 1 converts from R, G, B into Y, M, C to use as image data, and uses the same Bk data as the Bk data extracted on the host apparatus 100 side as text data.

The CPU retrieves the recording control commands (various parameter values) stored in the buffer memory 95*a*, and according to these parameter values and the program and program data expanded in the RAM, controls each electromechanical component as described below.

First, the CPU drives an actuator not shown via the actuator control section 95*d* (ON state), shifts the cleaning roller 31 to the operating position as shown in FIG. 2, and makes preparation for receiving a card C. At this point, the transport rollers 41, 42 are positioned in first positions (home positions) to form the substantially horizontal card transport path (the state shown in FIG. 2).

Next, the CPU actuates the transport driving motor 70 via the actuator control section 95*d*, while driving each roller disposed on the card transport path P1 via the driving transfer mechanism, and drives the motor, omitted in the figure, for driving the supply roller 11 to rotate via the actuator control section 95*d*.

By this means, the lowermost card C in the card supply section 10 is carried inside the casing 2 via between the supply roller 12 and separation gate 13 and the card supply opening 14. The card C is cleaned on the printing surface by the cleaning roller 31, transported toward a card discharge opening 82 side along the card transport path P1, and is once halted (see FIG. 2). In addition, when the rear end of the card C is detected by the first card detection sensor comprised of the light-emitting device 48 and light-receiving device 49, using the card rear end detection as a trigger, the cleaning roller 31 shifts from the operating position as shown in FIG. 2 to a retreat position that is the home position as shown in FIG. 3.

Next, the CPU executes the printing operation. In addition, prior to descriptions of the printing operation, described is the image determination processing, ribbon positioning, card positioning, printing and peeling processing.

<Image Determination Processing>

Figure 14:
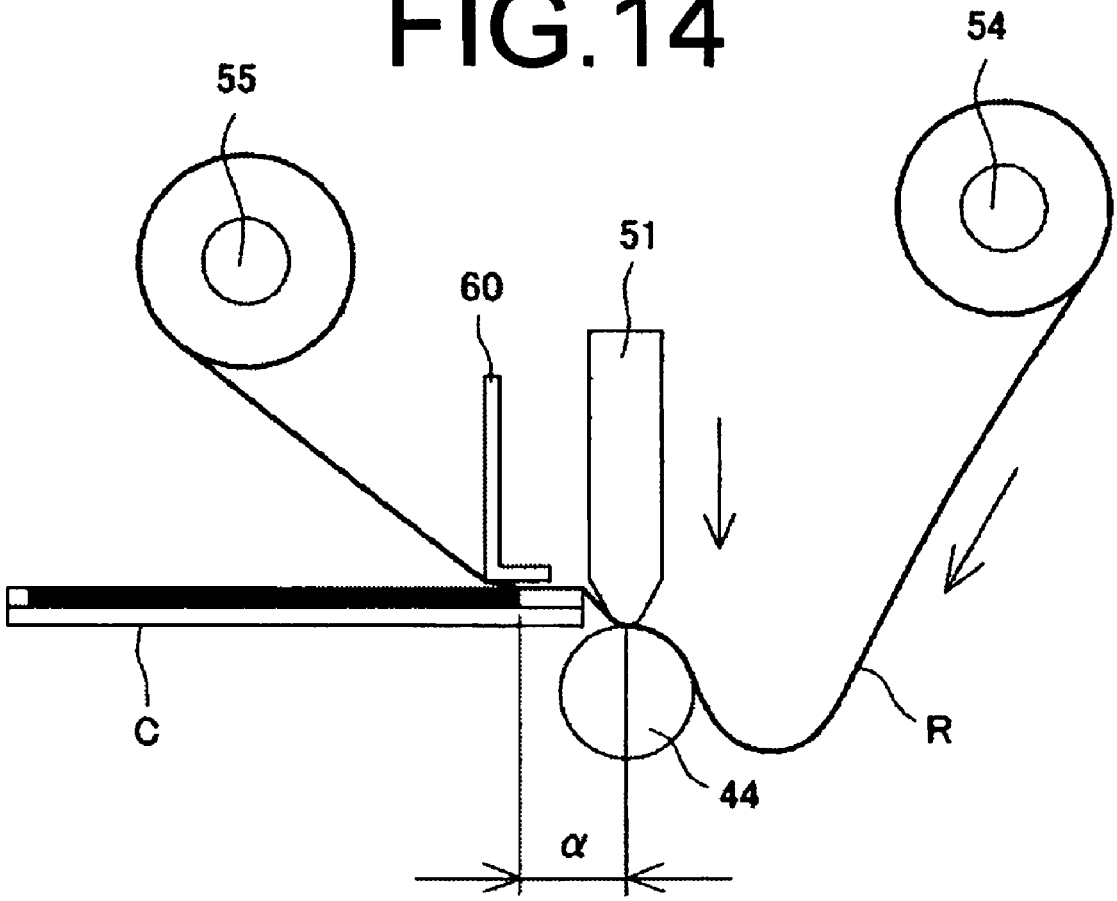
FIG. 14 is still another diagram to explain the printing operation of the Embodiment and shows a state in which the ink ribbon sags after printing is finished.
Figure 16:
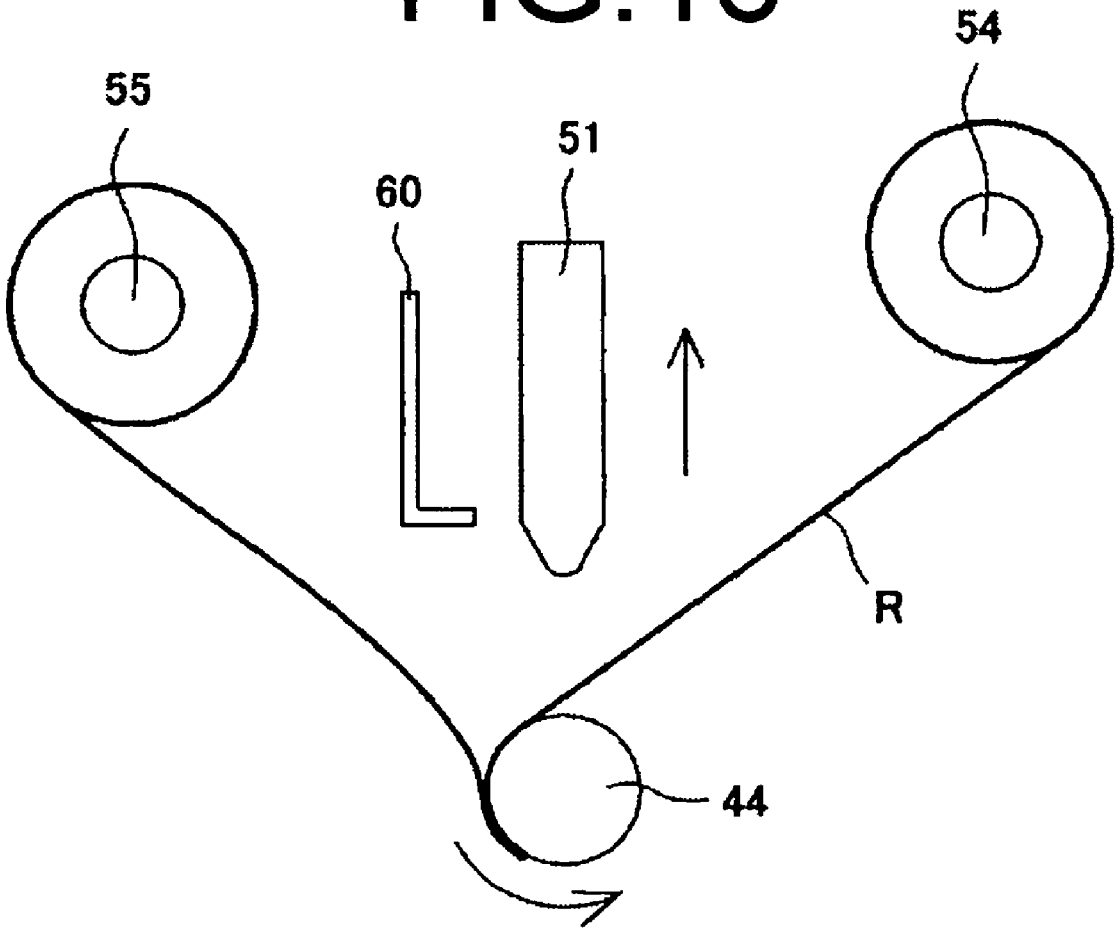
FIG. 16 is a diagram showing a state in which a sagging ink ribbon winds itself around the platen roller in a conventional printer apparatus.

In this Embodiment, to peel off the ink ribbon R from the card C, transport of the card C and reeling of the ink ribbon R is performed for the distance α after printing is finished. However, in the case where the printing finish position is within the distance α from the card rear end, when transport of the card C and reeling of the ink ribbon R is performed for the peeling distance α after printing the image data, since the rear end of the card passes through the thermal head 51 during the period, the thermal head 51 drops onto the platen roller 44. By this means, the ink ribbon R is pulled out of the ribbon supply reel 54, and sags (see FIG. 14). When the thermal head 51 is raised in this state and the platen roller 44 is rotated for card positioning, described later, the ink ribbon R winds itself around the platen roller 44 (see FIG. 16).

Figure 7:
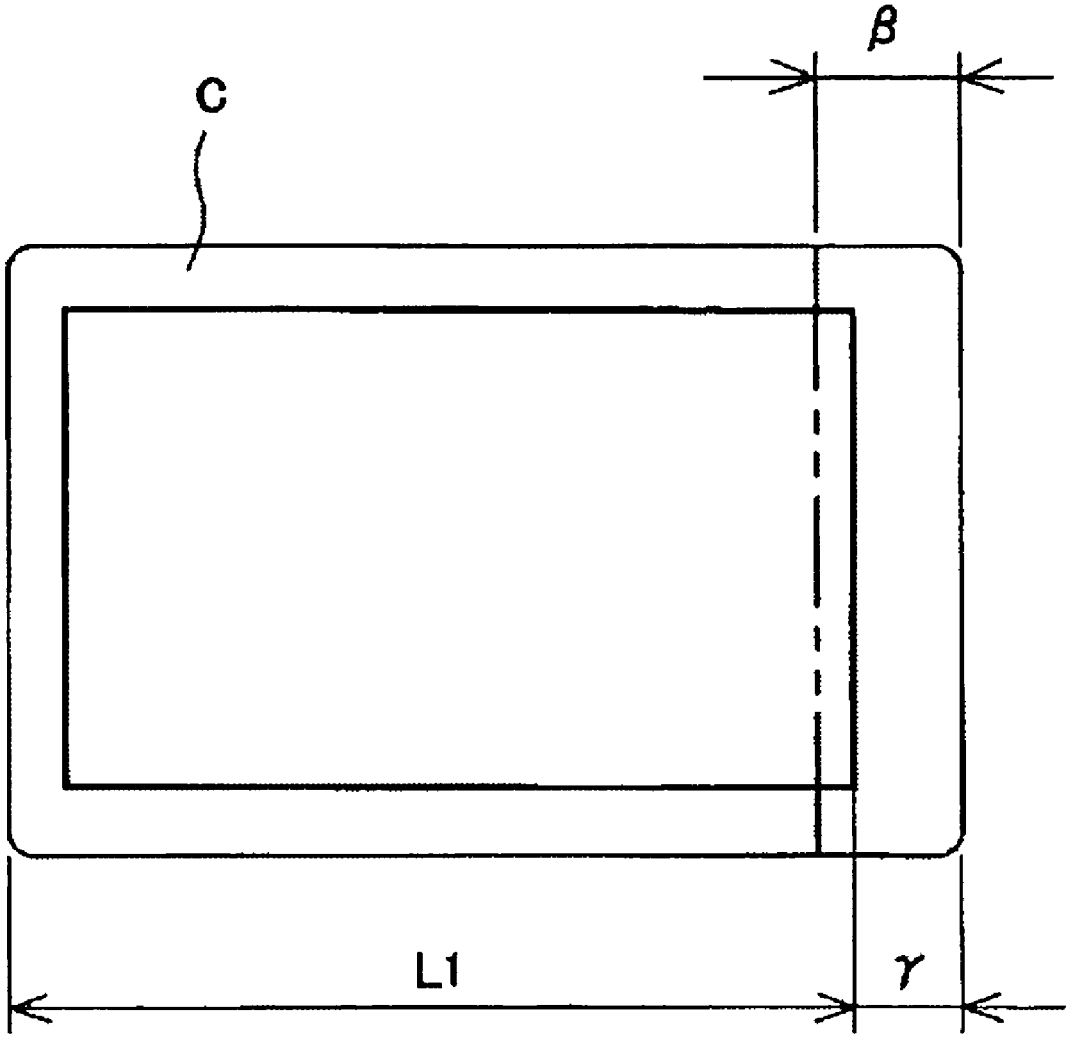
FIG. 7 is a diagram illustrating the relationship between the card and a region of image data.

In other words, when the printing finish position is within the distance α from the card rear end, it is necessary to reel the ink ribbon R more than usual after printing is finished. Therefore, the CPU determines whether or not the printing finish position of the image data stored in the buffer memory 95*a* is within a distance β from the card rear end. In addition, the distance β is 15 mm by providing the distance α with a margin, and can be set as appropriate corresponding to the distance α (as long as distance β>the distance α). More specifically, the CPU calculates a distance γ from the read end of the image data to the rear end of the card C, and determines whether the distance γ is the distance β or less (see FIG. 7).

In addition, the distance γ is used as an offset value in ribbon positioning and peeling processing as described later. In this Embodiment, when the distance γ is the distance β or less, the offset value is set at the distance γ. Meanwhile, when the distance γ is more than the distance β, the offset value is set at zero.

<Ribbon Positioning>

The CPU drives the take-up reel driving motor 150 via the actuator control section 95*d*, reels the ink ribbon R of the cartridge 52 to the ribbon take-up reel 55 side, and prior to printing, positions the ink ribbon R, for example, so that a predetermined position of the ink layer Y (Yellow) is positioned in a printing start position.

The CPU drives the take-up reel driving motor 150, reels the ink ribbon R of the ink cartridge 52 to the ribbon take-up reel 55 side, detects a rotation amount (i.e. the number of steps of the take-up reel driving motor 150) of the supply reel 54 between the instance when the transmission sensor comprised of the light-emitting device 58 and light-receiving device 59 detects the end portion of the ink layer Bk (Black) (i.e. the instance when the light-receiving device 59 detects that emission from the light-emitting element 58 becomes a permeable state from an impermeable state by the ink layer Bk) and the instance when the sensor detects the trailing edge portion of the ink layer Bk, using an encoder sensor 251, stores the rotation amount in the RAM, and calculates the current ribbon position and a printing start position of each color of the next screen.

Thereafter, the CPU further reels the ink ribbon R, detects a ribbon positioning mark R1 existing in between the protective layer Op and ink layer Y, further drives the take-up reel driving motor 150 by the predetermined number of steps, and shifts the ink ribbon R to the printing start position.

In this Embodiment, in performing printing, the center of the image data is registered with respect to the center of each panel (Y/M/C/Bk/Op) of the ink ribbon R, and the ink ribbon R is positioned in the printing start position (assuming that the width of the image data is L1 and that the width of each panel is L2, each center is registered.) However, as a result of the above-mentioned image determination processing, when the printing finish position is within the distance β from the card rear end, it is necessary to reel the ink ribbon R more than usual after printing is finished so as to eliminate the sag of the ink ribbon R.

Figure 8A:
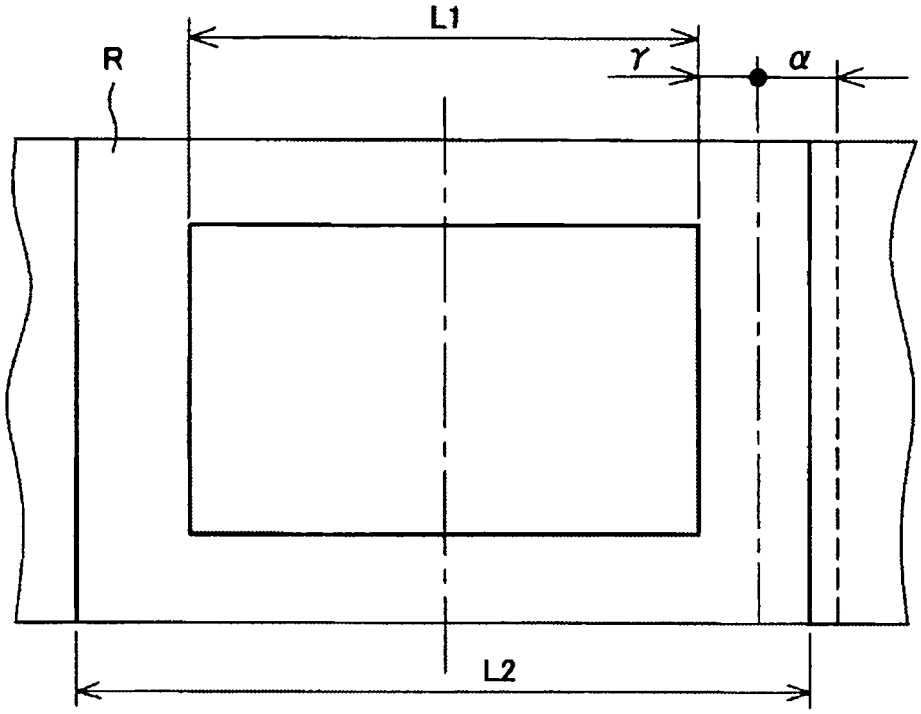
FIG. 8 contains diagrams illustrating the relationship between an ink ribbon and image data in positioning the ribbon, where FIG. 8(*a*) shows the position prior to correction, and FIG. 8(*b*) shows the position subsequent to correction.
Figure 8B:
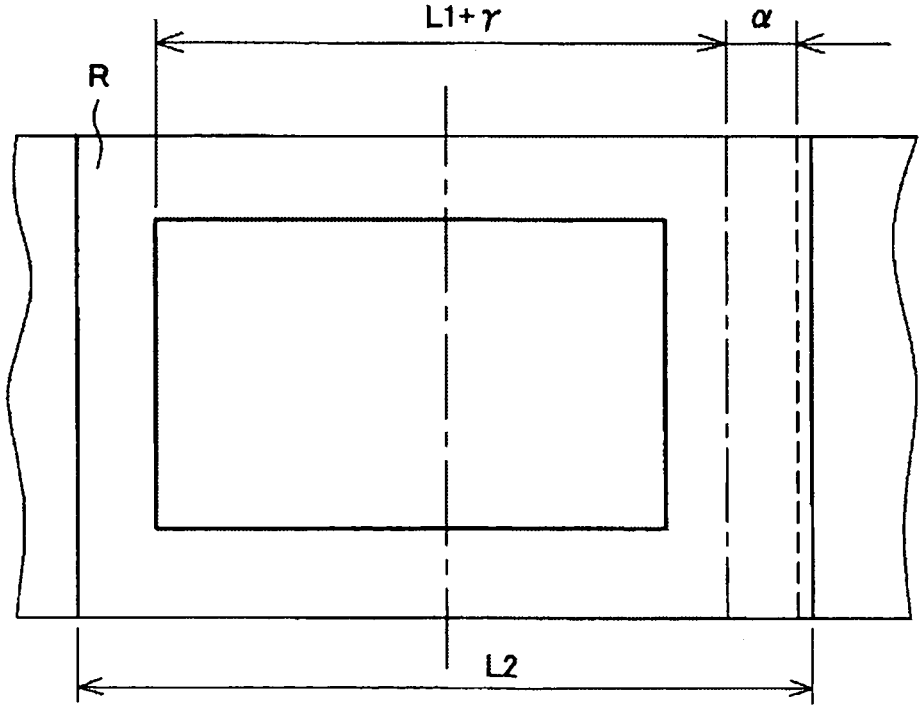

In this Embodiment, the ink ribbon is reeled by the distance γ in addition to the distance α from the printing finish position. Accordingly, in the case that the width of each panel of the ink ribbon R is short, when the ink ribbon is R reeled to eliminate the sag, there is a possibility that the front end of the next panel passes through the thermal head 51 (see FIG. 8(*a*)). To resolve the problem, since the distance from the printing finish position to the rear end of the panel needs to be increased, the printing start position is offset on the front end side of the panel. In this Embodiment, the sum (L1+γ) of the width L1 of the image data and the above-mentioned offset value (distance γ) is calculated as a width of the image data, the center is aligned with the center of the ink ribbon R, and the printing start position is thus corrected to the front end side of the panel of the ink ribbon R (see FIG. 8(*b*)).

Figure 9:
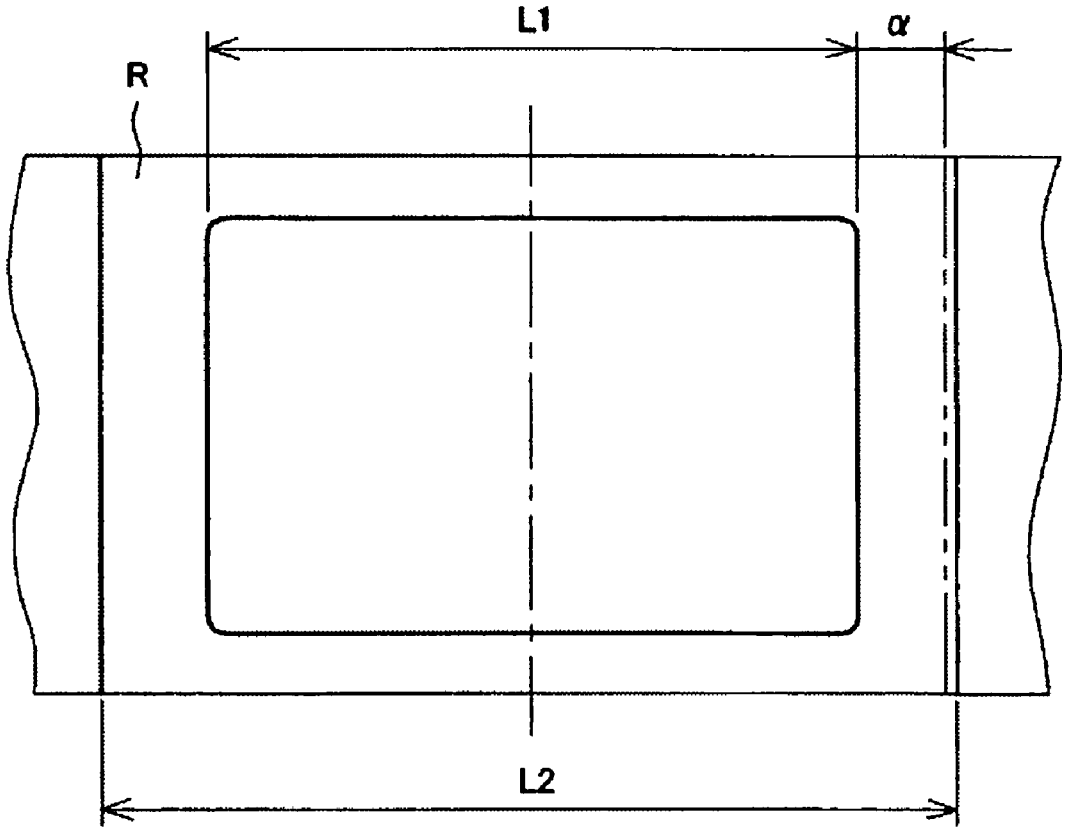
FIG. 9 is a diagram illustrating the position relationship between the ink ribbon and image data in all-surface printing.

In addition, as described above, in the case of all-surface printing, since the distance from the printing finish position to the card rear end is zero, the offset value is set at zero. Accordingly, in the case that the printing finish position is within the distance β from the card rear end, even when the ink ribbon R is reeled by the distance γ in addition to the distance a after printing is finished, the ink ribbon of the same region (see FIG. 9) as that in the all-surface printing is used at the maximum.

<Card Positioning>

The CPU drives the transport driving motor 70 to rotate forward, transports the card C toward the card discharge opening 82 side on the card transport path P1, and detects the front end position of the card C using the first card detection sensor comprised of the light-emitting device 48 and light-receiving device 49. Then, the CPU further drives the transport driving motor 70 by the predetermined number of steps from the detection position, and aligns the front end of the card C with the printing position.

Further, to print an image of the next color on the card C, the CPU drives the transport driving motor 70 to rotate backward, and transports the card C in the direction of the card supply section 10 on the card transport path P1. When the card arrives at a predetermined position, the CPU drives the transport driving motor 70 to rotate forward again, and transports the card C to the printing position. Then, when the CPU aligns the card C with the printing position, the CPU performs the same procedure.

<Printing and Peeling Processing>

Then, the CPU prints predetermined text and image by the printing data on the surface of the card C using the printing section 50. In other words, with the ink ribbon R (for example, portion of the ink layer Y) existing on the surface of the card C, the CPU drives a thermal head lifting/lowering motor 300 via the actuator control section 95*d*, shifts the thermal head 51 from the retreat position to the printing position, and selectively actuates a heating element of the thermal head 51 according to the image data (image data such that the Y component is color-converted from the RGB data) of Y color while pressing the thermal head 51 against the card C. By this means, a thermal transfer ink component of Y (Yellow) color applied to the ink ribbon R is directly transferred onto the surface of the card C.

Figure 10:
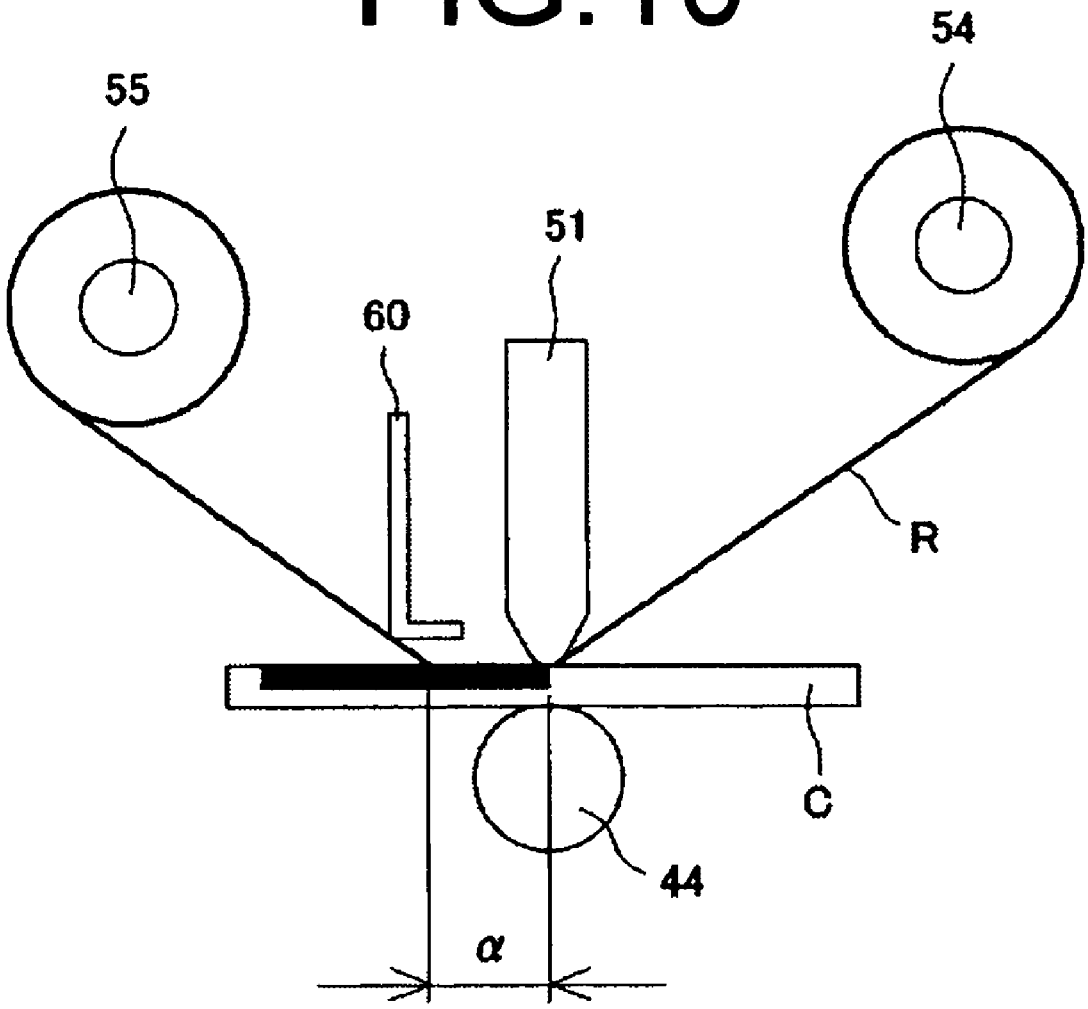
FIG. 10 is a diagram to explain the printing operation of the Embodiment and shows a state during printing.
Figure 11:
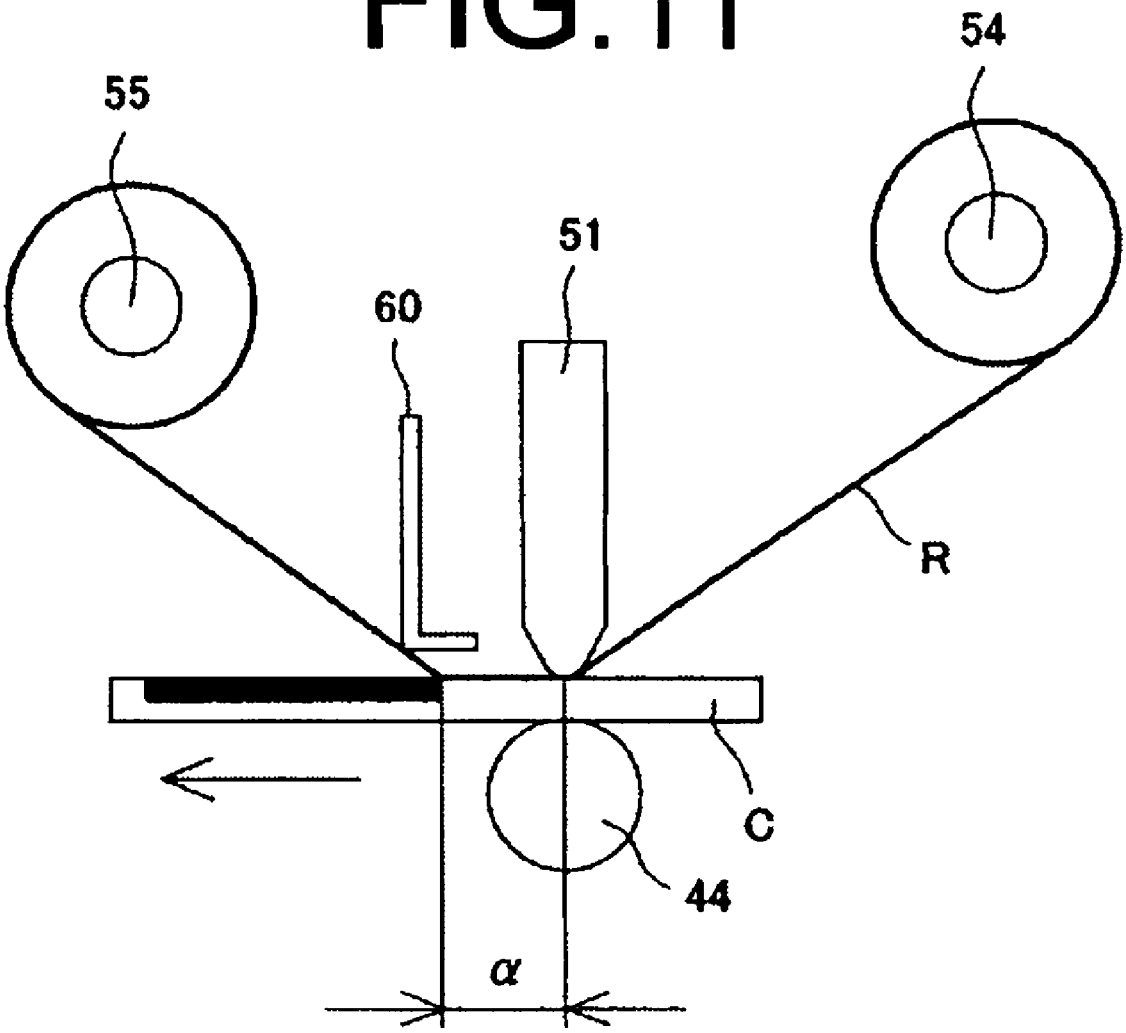
FIG. 11 is another diagram to explain the printing operation of the Embodiment and shows a state in which the ink ribbon peels off from the card after printing is finished.
Figure 12:
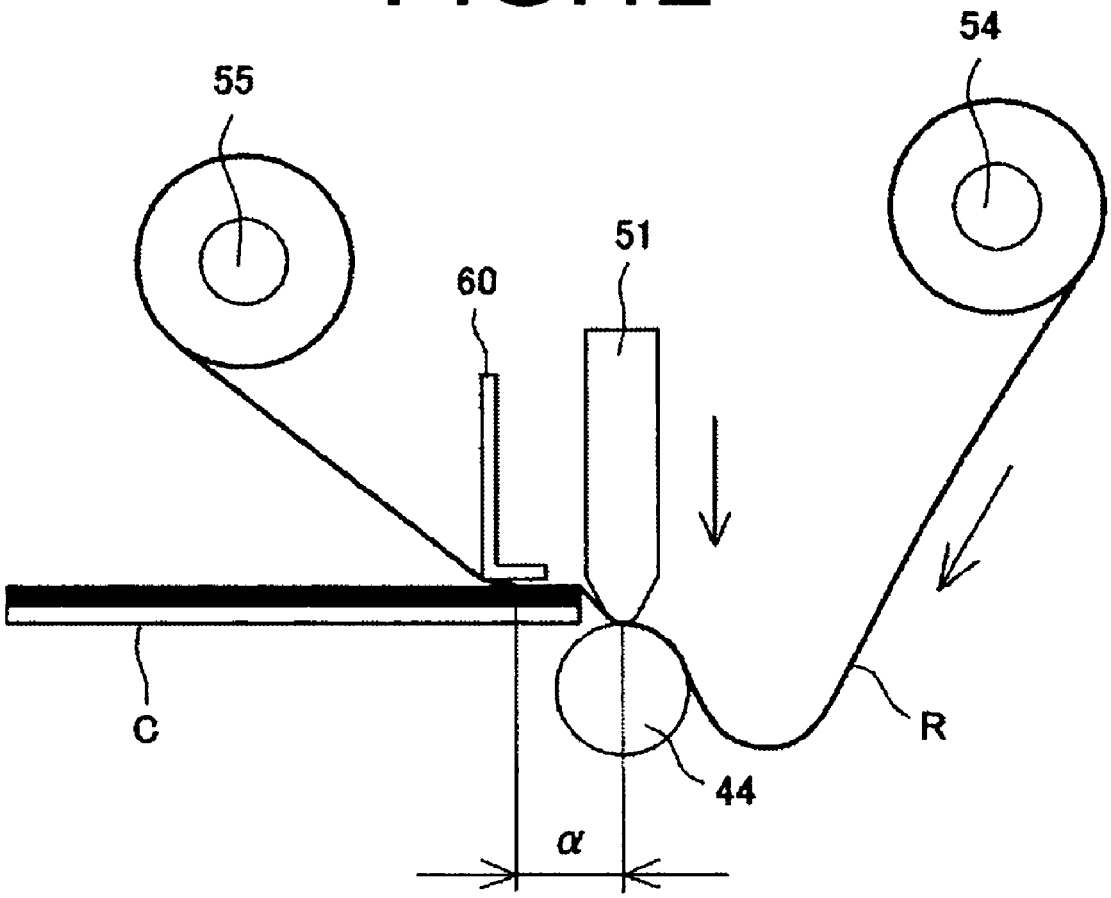
FIG. 12 is still another diagram to explain the printing operation of the Embodiment and shows a state in which the ink ribbon sags after all-surface printing is finished.
Figure 13:
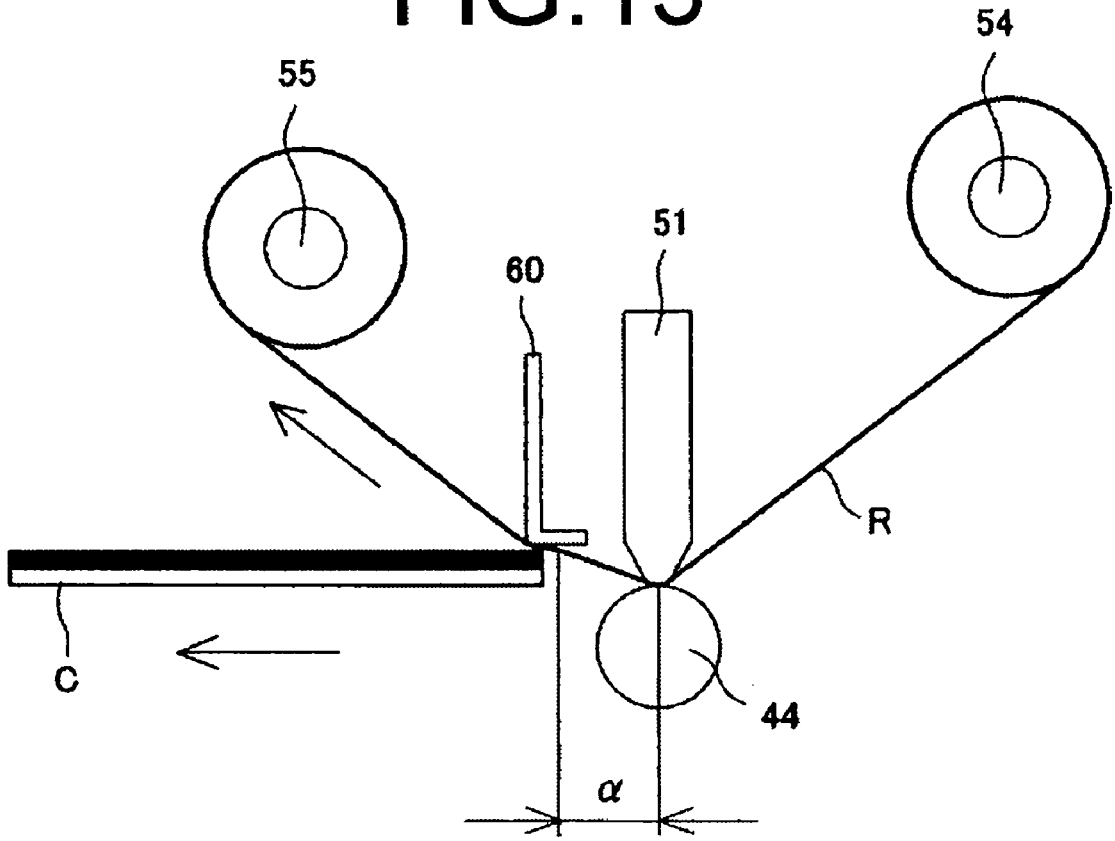
FIG. 13 is still another diagram to explain the printing operation of the Embodiment and shows a state in which the sag of the ink ribbon is resolved after all-surface printing is finished.
Figure 15:
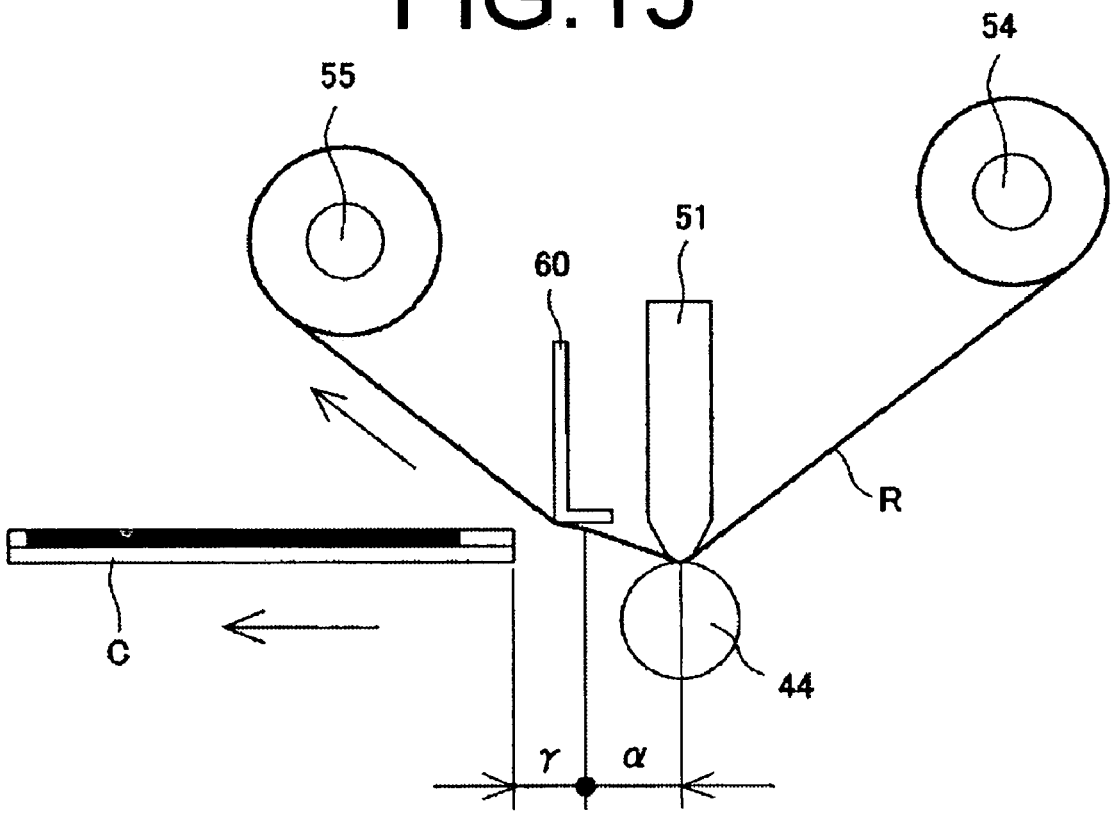
FIG. 15 is still another diagram to explain the printing operation of the Embodiment and shows a state in which the sag of the ink ribbon is resolved after printing is finished.

When printing of the image data of Y color is finished, to peel off the ink ribbon R from the card C, the CPU drives the transport driving motor 70 and take-up reel driving motor 150 until the printing finish position of the card C arrives at the peeling point (distance α), and transports the card C while reeling the ink ribbon R (see FIGS. 10 and 11). As described above, when the printing finish position of the image data is within the distance β from the card rear end, since the distance γ is set as an offset value, reeling of the ink ribbon R and transport of the card C is performed by the distance γ in addition to the distance α after printing is finished, and the ink ribbon R peels off from the card C during the process (see FIGS. 14 and 15).

In this Embodiment, a take-up amount of the ink ribbon R during the printing and peeling processing is controlled by the rotation amount (driving amount of the stepping motor 70) of the platen roller 44. Accordingly, after the card C passes through between the thermal head 51 and platen roller 44, the ink ribbon R is nipped by the thermal head 51 and platen roller 44, and reeling of the ink ribbon is performed while rotating the platen roller 44. Then, the thermal head lifting/lowering motor 300 is driven to shift the thermal head 51 to the retreat position, and ribbon positioning of the next color (M color) is performed.

<Printing Operation>

Figure 6:
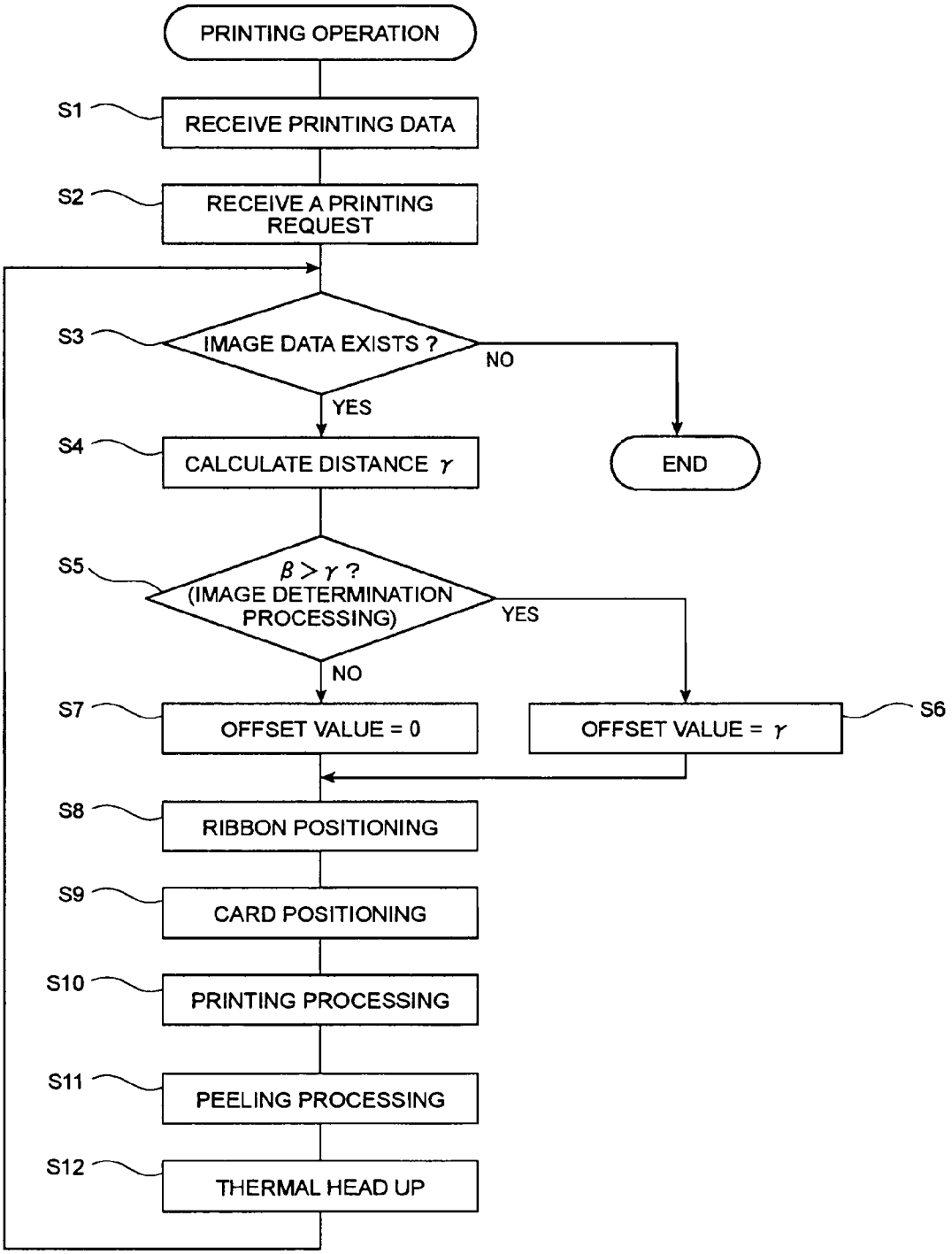
FIG. 6 is a flowchart to explain the flow of printing operation of the Embodiment.

The flow of the printing operation will be described below. FIG. 6 shows the flow of the entire printing operation. First, printing data is received from the host apparatus, and is stored in the buffer memory 95*a* as image data (S1). Then, when a printing request is received (S2), it is determined whether or not image data (for example, Y color) exists (S3). When there is the image data to print, the distance γ from the printing finish position of the image data to the card rear end is calculated (S4). Then, the distance β set corresponding to the peeling distance α is compared with the distance γ calculated in S4, and it is determined whether or not the printing finish position is within the distance β from the card rear end (image determination processing S5). In the case of a positive determination, the offset value is set at the distance γ (in the case of all-surface printing, set at zero) (S6). Meanwhile, in the case of a negative determination, the offset value is set at zero (S7). Then, in addition to the offset value, the ribbon positioning is performed (S8). Further, while performing the ribbon positioning, card positioning is performed (S9). When the ribbon positioning and card positioning is completed, the thermal head 51 is shifted, and the printing processing is performed (S10). At this point, after printing is finished, corresponding to the distance α in addition to the offset value set in S6 or S7, the card C is transported, while reeling the ribbon R (peeling processing S11). After the peeling processing is finished, the thermal head 51 is raised to the retreat position (S12). Then, the flow returns to S3, it is determined whether or not image data of the next color (M color) exists, and when the image data exists, the same processing is performed.

Meanwhile, in the determination in S3, when the image data to print is not stored (when all colors are printed), the sag of the ink ribbon R caused by rising of the thermal head 51 is reeled, and the printing operation is finished. Then, the card C is transported, and is discharged to the card holding section 20. In this way, the printing processing on a single card is finished, and when there is a next job, the aforementioned operation is repeated.

(Effect, etc.)

Described next are the effect and others of the printer apparatus 1 of this Embodiment. As described above, in this Embodiment, the distance γ from the printing finish position of image data received from the host apparatus 100 to the card rear end is compared with the distance β set corresponding to the peeling distance α in which the ink ribbon R peels off from the card C, and it is thereby determined whether or not the printing finish position is within the distance β from the card rear end. Then, as a result, in the case of a positive determination, a value of the distance γ is set as an offset value, and it is controlled that transport of the card C and reeling of the ink ribbon R by a distance obtained by adding the offset value to the distance α is performed after printing on the card C is finished, and that the thermal head 51 is then retreated to the retreat position. By this means, even when the ink ribbon R once sags by the thermal head 51 dropping for a period during which the card C is transported for the distance α in order for the ink ribbon R to peel off after printing on the card C is finished, the printing operation is not finished with the ink ribbon R sagging, and therefore, the ink ribbon R does not wind itself around the platen roller 44.

At this point, the take-up amount of the ink ribbon R is controlled corresponding to the rotation amount of the platen roller 44. In other words, the ink ribbon R and the card C are transported for the same amount during printing, and after the rear end of the card C passes through the thermal head 51 and the thermal head 51 drops, the thermal head 51 and the platen roller 44 nip the ink ribbon R, and transport the ink ribbon R.

In addition, the encoder for detecting the rotation amount is provided in the ribbon take-up reel 55, but since the ink ribbon R subsequent to printing is stretched by heat, it is not possible to control the accurate take-up amount. Accordingly, the CPU detects the rotation amount of the platen roller 44 i.e. the rotation amount of the transport driving motor 70, and is thereby capable of controlling the accurate take-up amount of the ink ribbon R. In addition, a sensor may be provided to directly detect the rotation amount of the platen roller 44.

Further, in this Embodiment, since ribbon positioning is performed by aligning the center of the width of the image data with the center of the width of the panel of the ink ribbon R, when the ink ribbon R is simply reeled by a distance obtained by adding the offset value to the distance α after printing is finished, there is a case that the front end of the next panel of the ink ribbon passes through the thermal head 51. Accordingly, to prevent such passage, in performing ribbon positioning, ribbon positioning is performed so that the center of the width (L1+γ) obtained by adding the offset value (γ) to the width L1 of the image data is aligned with the center of the width L2 of the panel. As a result, the printing start position is offset on the front end side of the panel, and therefore, even when the ink ribbon R is reeled excessively, the front end of the next panel does not pass through the thermal head 51.

In addition, this control does not need to be performed when the width L2 of the panel of the ink ribbon R is long, but when the width of the panel is increased, an unused wasted portion arises corresponding to the increase, resulting in adverse effects in cost and environment. Accordingly, the printing apparatus 1 of this Embodiment is capable of effectively using the ink ribbon with the limited width. Further, the issue is that the front end of the next panel of the ink ribbon R passes through the thermal head 51 by reeling the ink ribbon R more than usual, but instead of the front end of the next panel, it is adequate not to go over the printing start position in all-surface printing of the next panel. This problem can be resolved if the ribbon supply reel 54 is provided with winding back driving, but such a mechanism increases the number of parts. In other words, the invention is effective in the configuration that the ribbon supply reel 54 is not provided with driving.

This application claims priority from Japanese Patent Application No. 2009-200004 incorporated herein by reference.

What is claimed is:

1. A printing apparatus for printing an image on a card-shaped printing medium while bringing a thermal head into press-contact with a platen roller with an ink ribbon existing therebetween, comprising:

thermal head shifting means for shifting the thermal head between a printing position and a retreat position spaced from the printing position;

a ribbon supply reel around which an used portion of the ink ribbon is wound;

a ribbon take-up reel in which a used portion of ink ribbon is reeled;

take-up reel driving means for providing the ribbon take-up reel with driving;

transport means for transporting the printing medium;

a peeling member provided on the take-up reel side with respect to the thermal head to peel off the ink ribbon from the printing medium at a point a distance α from the thermal head;

control means for controlling the take-up reel driving means, and driving of the transport means and the thermal head shifting means;

data receiving means for receiving printing data; and determining means for determining whether or not a printing finish position is within a predetermined distance β from a rear end of the printing medium, from the received printing data, wherein a distance from the printing finish position to the rear end of the printing medium is defined as a distance γ;

the distance β is set corresponding to the distance α, and when the determining means determines that the printing finish position is within the distance β from the rear end of the printing medium, the control means reels the ink ribbon by at least a distance obtained by adding the distance α and the distance γ after the printing data is printed, and then, controls the take-up reel driving means and the thermal head shifting means so as to shift the thermal head to the retreat position.

2. The printing apparatus according to claim 1, further comprising:

detecting means for detecting a rotation amount of the platen roller, wherein the control means controls a driving amount of the take-up reel driving means for a period during which the thermal head is in the printing position, corresponding to the detecting means.

3. The printing apparatus according to claim 1, wherein the ink ribbon is formed of panel-sequential panels of a plurality of colors, and when the determining means determines that the printing finish position is within the distance β from the rear end of the printing medium, a printing start position is displaced to the front end side of the panel to perform printing.

4. A printing method for printing an image on a card-shaped printing medium while bringing a thermal head into press-contact with a platen roller with an ink ribbon existing therebetween, including:

a data receiving step of receiving printing data;

a calculating step of calculating a distance γ from a printing finish position of the received printing data to a rear end of the printing medium;

a comparing step of comparing the distance γ with a distance β;

a ribbon positioning step of performing positioning of the ink ribbon;

a printing medium positioning step of performing positioning of the printing medium;

a first head shifting step of shifting the thermal head to a printing position;

a printing step of printing the printing data on the printing medium;

a ribbon reeling step of reeling the ink ribbon after printing is finished; and a second head shifting step of shifting the thermal head to a retreat position, wherein a distance from the thermal head to a point in which the ink ribbon peels off from the printing medium is defined as a distance α, the distance β is set corresponding to the distance α, and when it is determined that the distance γ is less than the distance β in the comparing step, the ink ribbon is reeled by at least a distance obtained by adding the distance α and the distance γ.

5. The printing method according to claim 4, wherein the ink ribbon is formed of panel-sequential panels of a plurality of colors, and when it is determined that the distance γ is less than the distance β in the comparing step, a printing start position is corrected to the front end side of the panel in the ribbon positioning step.

* * * * *